US006662379B2

(12) United States Patent
Nguyen et al.

(10) Patent No.: US 6,662,379 B2
(45) Date of Patent: Dec. 16, 2003

(54) TOILET CLEANING DISPENSER SYSTEM WITH REMOVABLE CARTRIDGE

(75) Inventors: Jack T. Nguyen, Rancho Santa Margarita, CA (US); Farid Maiwandi, Laguna Hills, CA (US); Dan Lodhe, Aliso Viejo, CA (US); Christopher A. Coppock, Laguna Niguel, CA (US); Troy A. Bell, Irvine, CA (US)

(73) Assignee: Fluidmaster, Inc., San Juan Capistrano, CA (US)

( * ) Notice: Subject to any disclaimer, the term of this patent is extended or adjusted under 35 U.S.C. 154(b) by 0 days.

(21) Appl. No.: 10/033,611

(22) Filed: Dec. 27, 2001

(65) Prior Publication Data

US 2003/0121089 A1 Jul. 3, 2003

(51) Int. Cl.[7] ..... E03D 9/00
(52) U.S. Cl. ..... 4/225.1; 4/227.1; 4/227.4
(58) Field of Search ..... 4/225.1, 227.1, 4/227.4–227.6, 222–224

(56) References Cited

U.S. PATENT DOCUMENTS

| | | | | | |
|---|---|---|---|---|---|
| 2,424,174 | A | * | 7/1947 | Jensen et al. | 4/225.1 |
| 3,228,040 | A | | 1/1966 | Currie | 4/226 |
| 3,311,931 | A | | 4/1967 | Kritensen et al. | 4/227 |
| 3,423,182 | A | * | 1/1969 | Klasky | 422/266 |
| 4,841,578 | A | | 6/1989 | Mercer | 4/224 |
| 4,993,084 | A | * | 2/1991 | McCauley et al. | 4/224 |
| 5,774,903 | A | * | 7/1998 | Wilson et al. | 4/227.1 |
| 5,778,459 | A | | 7/1998 | Guerin | 4/225.1 |
| 5,815,850 | A | | 10/1998 | Shon | 4/225.1 |
| 5,881,396 | A | * | 3/1999 | Rivera | 4/225.1 |
| 5,918,320 | A | | 7/1999 | Reals | 4/225.1 |
| 6,112,949 | A | * | 9/2000 | Rhodes et al. | 222/153.02 |
| 6,151,722 | A | | 11/2000 | Lubrano | 4/225.1 |
| 6,240,572 | B1 | * | 6/2001 | Van Der Gaag et al. | 4/225.1 |
| 6,321,392 | B1 | * | 11/2001 | Sim | 4/225.1 |

* cited by examiner

*Primary Examiner*—Gregory L. Huson
*Assistant Examiner*—Amanda Flynn
(74) *Attorney, Agent, or Firm*—Richard L. Myers; Myers Dawes Andras & Sherman, LLP

(57) ABSTRACT

A toilet cleaning dispenser system adapted for placement in a toilet tank includes a hanger, a dispenser housing and a cartridge device removably coupled to the dispenser housing. The cartridge device, which includes a cleanser tablet enclosed within a cartridge housing, is inserted into a cavity of the dispenser housing and turned in one direction to lock the device and, alternatively, in an opposite direction to unlock the device. The cartridge housing may be formed to turn as one unit, or be formed as a basket and a rotatable cap that can be turned with respect to the basket. The dispenser housing includes an inlet water trap and an outlet water trap, each comprising a pair of concentric, nested tubes that retain liquid after flushing so as to prevent fumes from exiting the dispenser housing into the toilet tank.

21 Claims, 12 Drawing Sheets

FIG. 5A
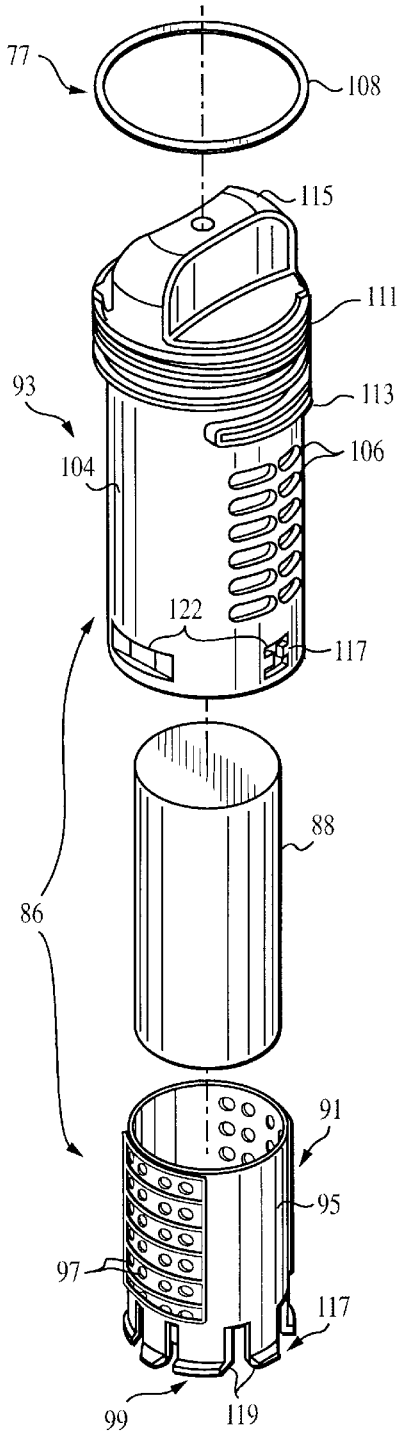
FIG. 5B
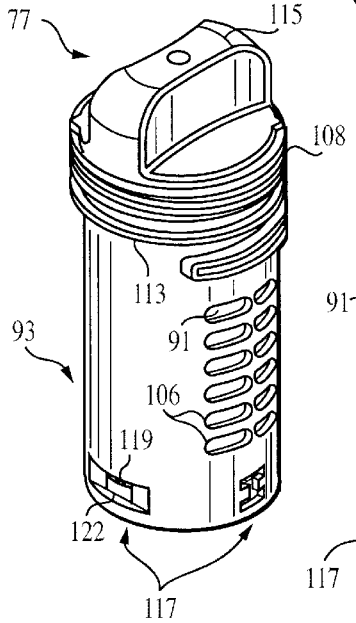
FIG. 5C
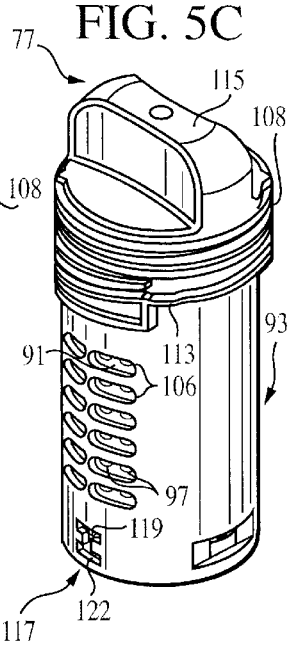
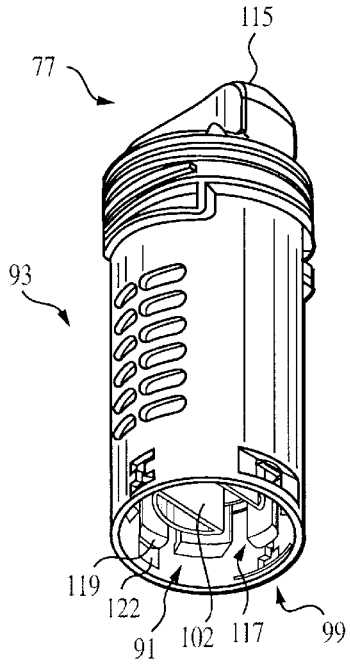
FIG. 5D

FIG. 11A
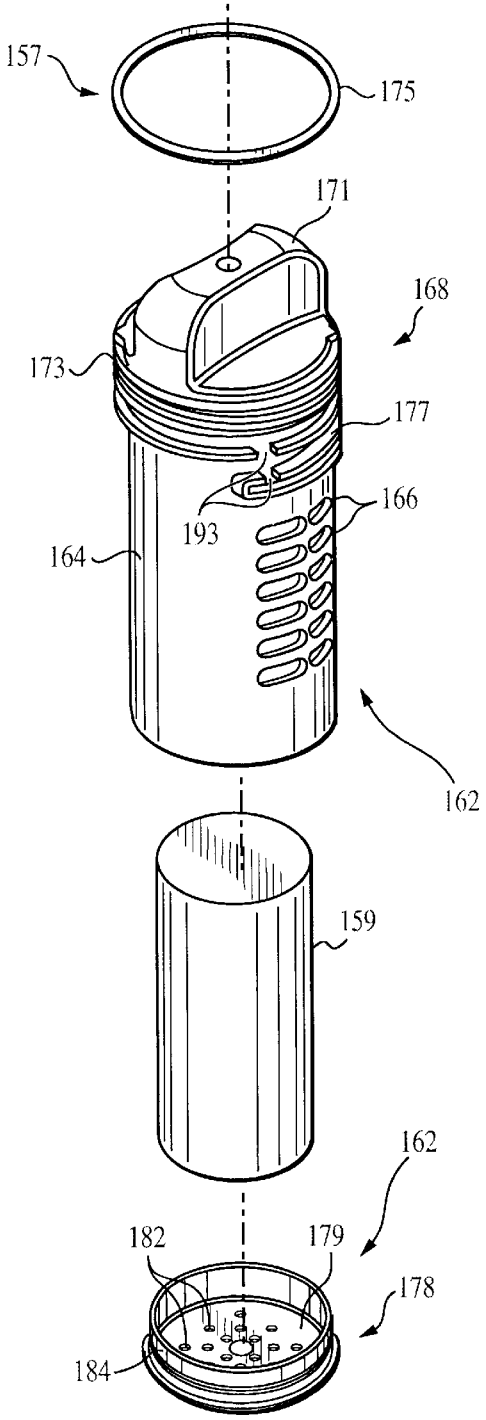
FIG. 11B
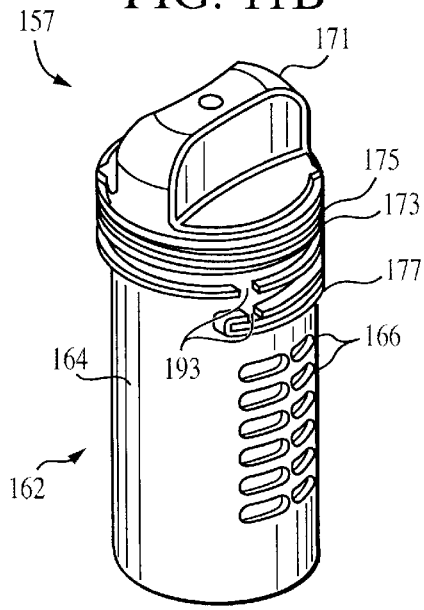
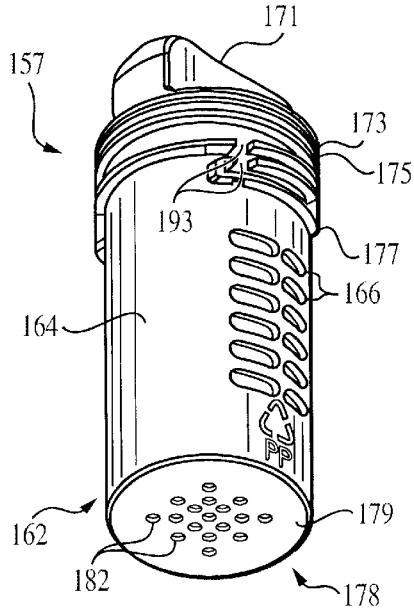
FIG. 11C

TOILET CLEANING DISPENSER SYSTEM WITH REMOVABLE CARTRIDGE

BACKGROUND OF THE INVENTION

1. Field of the Invention

The invention relates generally to cleaning dispensers for toilet tanks.

2. Description of Prior Art and Related Information

Cleaning systems for toilets typically include a cleaning agent composed of water soluble material formed into a tablet. The tablet is commonly disposed in the toilet bowl or the toilet tank. When placed in the toilet bowl, the cleaning agent is coupled to an interior of the bowl by supporting means, such as wires. Since a cleaning agent must be capable of dissolving quickly due to the short duration in which passing water makes contact with the agent, such cleaning agents get used quickly. This requires the frequent replacement of the supporting means. Since the supporting means is located in the toilet bowl, manually replacement can be messy and undesirable.

Cleaning agents, such as tablets, for placement in a toilet tank are also adapted to dissolve quickly. This results in the release of fumes and various other gases which can cause damage to the plumbing of toilet tank. Cleaning agents placed inside the tank are adapted to be dissolved by a large volume of water, which volume passes through with each flush. As a result, much of the cleaning agent is wasted, thereby requiring frequent replacement.

Cleaning agents, provided in the form of cleanser tablets, for example, may contain chemicals which are harmful upon direct contact with human skin and eyes. Replacement cleanser tablets which are commonly sold separately require the user to make direct contact as the tablet is removed from its packaging and placed into a dispenser. Furthermore, common cleanser tablets which are often brightly colored may tempt younger children to touch or even ingest the cleaning agent, especially if placed in the toilet bowl where a child can gain access.

SUMMARY OF THE INVENTION

In accordance with the present invention, structures and associated methods are disclosed which overcome these deficiencies.

In one aspect, a toilet cleaner dispensing system is provided. The system comprises a dispenser housing and a cartridge housing removably coupled to the dispenser housing. The dispenser housing includes an inlet water trap, an outlet water trap and an opening. The cartridge housing is configured to fit in the opening.

The inlet water trap comprises a first downwardly extending tube and a first upwardly extending tube axially aligned with the first downwardly extending tube. The first downwardly extending tube and the first upwardly extending tube have a nesting relationship. The outlet water trap comprises a second downwardly extending tube and a second upwardly extending tube axially aligned with the second downwardly extending tube. The second downwardly extending tube and the second upwardly extending tube also have a nesting relationship. A tablet composed of a toilet cleaning agent is disposed within the cartridge housing. The system further comprises means for releasably locking the cartridge housing to the dispenser housing. The system further comprises a detent locking mechanism. The detent locking mechanism comprises a projection included in the dispenser housing, and a void included in the cartridge housing and configured to receive the projection.

In another aspect, a removable toilet cartridge device is provided and adapted for use in connection with a toilet cleaner dispenser system. The cartridge device comprises a basket including a first sidewall having portions defining a first plurality of apertures, and a cap including a second sidewall having portions defining a second plurality of apertures. The cap is movable with respect to the basket to facilitate alternatively an open position and a closed position. In the open position, the first plurality of apertures has a communicating relationship with the second plurality of apertures. For example, the second plurality of apertures are aligned with the first plurality of apertures in the open position. In the closed position, the first plurality of apertures does not have a communicating relationship with the second plurality of apertures. The second plurality of apertures is preferably configured to match the first plurality of apertures. A cleanser tablet is enclosed within the cap and the basket. The cap further comprises a knob and external threads.

In a further aspect, a disposable toilet cleaning system adapted for use with a toilet including a tank is provided. The cleaning system comprises a toilet cleaning dispenser adapted for disposition in the tank of the toilet and a plurality of disposable cartridge devices. Thus, a single dispenser may be employed while each disposable cartridge device, once used, may be discarded and replaced with a new cartridge device. The dispenser includes a dispenser housing with an inlet water trap, an outlet water trap, and a cavity. Each disposable cartridge device comprises a cartridge housing and a cleanser tablet disposed within the cartridge housing. Each cartridge housing is compatible with the dispenser and thus configured to removably fit in the opening. The disposable cartridge housing comprises a cap with a first aperture and a basket having a second aperture. The cap is movable with respect to the basket to facilitate an open position in which the first aperture is aligned with the second aperture and a closed position in which the first aperture is not aligned with the second aperture. Each cartridge housing comprises a cylindrical sidewall with a first plurality of apertures and a base with a second plurality of apertures.

Accordingly, a disposable toilet cartridge device adapted for use in connection with a toilet cleaning dispenser housing is provided as well. The device comprises a cartridge housing adapted to be removably coupled to the cleaning dispenser housing and a cleansing tablet disposed within the cartridge housing. The cartridge housing comprises a basket and a cap. The cap is movable with respect to the basket to facilitate alternatively an open position providing fluid access to the cleansing tablet and a closed position blocking fluid access to cleansing tablet. The basket includes a first sidewall with a first aperture. The cap includes a second sidewall and a second aperture. The cap is rotatable with respect to the basket to facilitate alternatively the open position in which the first aperture is aligned with the second aperture and the closed position in which the first aperture is not aligned with the second aperture. The cap further comprises a knob.

In another aspect, a toilet cleaning dispenser assembly comprises a dispenser housing comprising an opening, and a cartridge device adapted to be releasably locked to the dispenser housing. The cartridge device comprises a cartridge housing configured to fit in the opening and a cleanser tablet disposed within the cartridge housing. At least a portion of the cartridge housing is movable with respect to the dispenser housing to facilitate alternatively a locked relationship with the dispenser housing and an unlocked relationship with the dispenser housing. The portion of the cartridge housing that is movable with respect to the dispenser housing comprises a cap with a knob. The cartridge housing further comprises a basket coupled to the cap. The cartridge housing may alternatively comprise a cylindrical sidewall with a first plurality of apertures and a base with a second plurality of apertures.

A method for installing and removing a toilet cleanser in a toilet tank is provided. The method comprises enclosing a cleanser tablet in a cartridge housing, inserting the cartridge housing in a dispenser housing, turning at least a portion of the cartridge housing in a first direction to lock the cartridge housing to the dispenser housing, and turning at least the portion of the cartridge housing in a second direction opposite to the first direction to unlock the cartridge housing from the dispenser housing.

The step of enclosing a cleanser tablet in a cartridge housing comprises the step of housing the cleanser tablet with a basket and a cap that is movable with respect to the basket. The step of turning at least a portion of the cartridge housing in a first direction to lock the cartridge housing to the dispenser housing comprises the step of rotating the cap in the first direction. The step of turning at least the portion of the cartridge housing in a second direction opposite to the first direction to unlock the cartridge housing from the dispenser housing comprises the step of rotating the cap in the second direction.

The method further comprises the step of keeping the basket stationary when the cap is rotated. The step of rotating the cap in the first direction comprises the step of providing fluid access to the cleanser tablet. The step of rotating the cap in the second direction comprises the step of blocking fluid access to the cleanser tablet. The step of turning at least a portion of the cartridge housing in a first direction to lock the cartridge housing to the dispenser housing comprises the step of rotating the cartridge housing as one unit in the first direction. The step of turning at least the portion of the cartridge housing in a second direction opposite to the first direction to unlock the cartridge housing from the dispenser housing comprises the step of rotating the cartridge housing as one unit in the second direction.

Furthermore, a method is provided for dispensing toilet cleanser in a toilet having a toilet tank, a fill tube and an overflow tube. The method comprises channeling liquid from a fill tube into a dispenser housing, absorbing a cleanser tablet in the dispenser housing with the channeled liquid, directing liquid out of the dispenser housing to the overflow tube, and preventing fumes from escaping the dispenser housing into the toilet tank.

The step of preventing fumes from escaping the dispenser housing into the toilet tank comprises the steps of blocking the fumes from entering the fill tube with a first water trap and blocking the fumes from entering the overflow tube with a second water trap. The step of blocking the fumes from entering the fill tube with a first water trap comprises the step of providing a first pair of concentric tubes in a nested relationship. The step of blocking the fumes from entering the overflow tube with a second water trap comprises the step of providing a second pair of concentric tubes in a nested relationship.

The method further comprises the step of preventing siphoning of liquid out of the dispenser housing through the fill tube. The step of preventing siphoning of liquid out of the dispenser housing through the fill tube comprises the step of providing the dispenser housing with an air check valve.

In summary, a toilet cleaning dispenser system adapted for placement in a toilet tank includes a hanger, a dispenser housing and a cartridge device removably coupled to the dispenser housing. The cartridge device, which includes a cleanser tablet enclosed within a cartridge housing, is inserted into a cavity of the dispenser housing and turned in one direction to lock the device and, alternatively, in an opposite direction to unlock the device. The cartridge housing may be formed to turn as one unit, or be formed as a basket and a rotatable cap that can be turned with respect to the basket. The dispenser housing includes an inlet water trap and an outlet water trap, each comprising a pair of concentric, nested tubes that retain liquid after flushing so as to prevent fumes from exiting the dispenser housing into the toilet tank.

The invention, now having been briefly summarized, may be better visualized by turning to the following drawings wherein like elements are referenced by like numerals.

BRIEF DESCRIPTION OF THE DRAWINGS

FIG. 5A is an exploded, perspective view of a cartridge device;

FIG. 5B is a perspective view of the cartridge device illustrating a closed position;

FIG. 5C a perspective view of the cartridge device illustrating an open position;

FIG. 5D is a bottom perspective view of the cartridge device;

FIG. 11A is an exploded, perspective view of a second preferred cartridge device;

FIG. 11B is a top perspective view of the second preferred cartridge device;

FIG. 11C is a bottom perspective view of the second preferred cartridge device.

The invention and its various embodiments can now be better understood by turning to the following detailed description wherein illustrated embodiments are described.

It is to be expressly understood that the illustrated embodiments are set forth as examples and not by way of limitations on the invention as ultimately defined in the claims.

DETAILED DESCRIPTION OF THE PREFERRED EMBODIMENTS AND BEST MODE OF INVENTION

Figure 1:
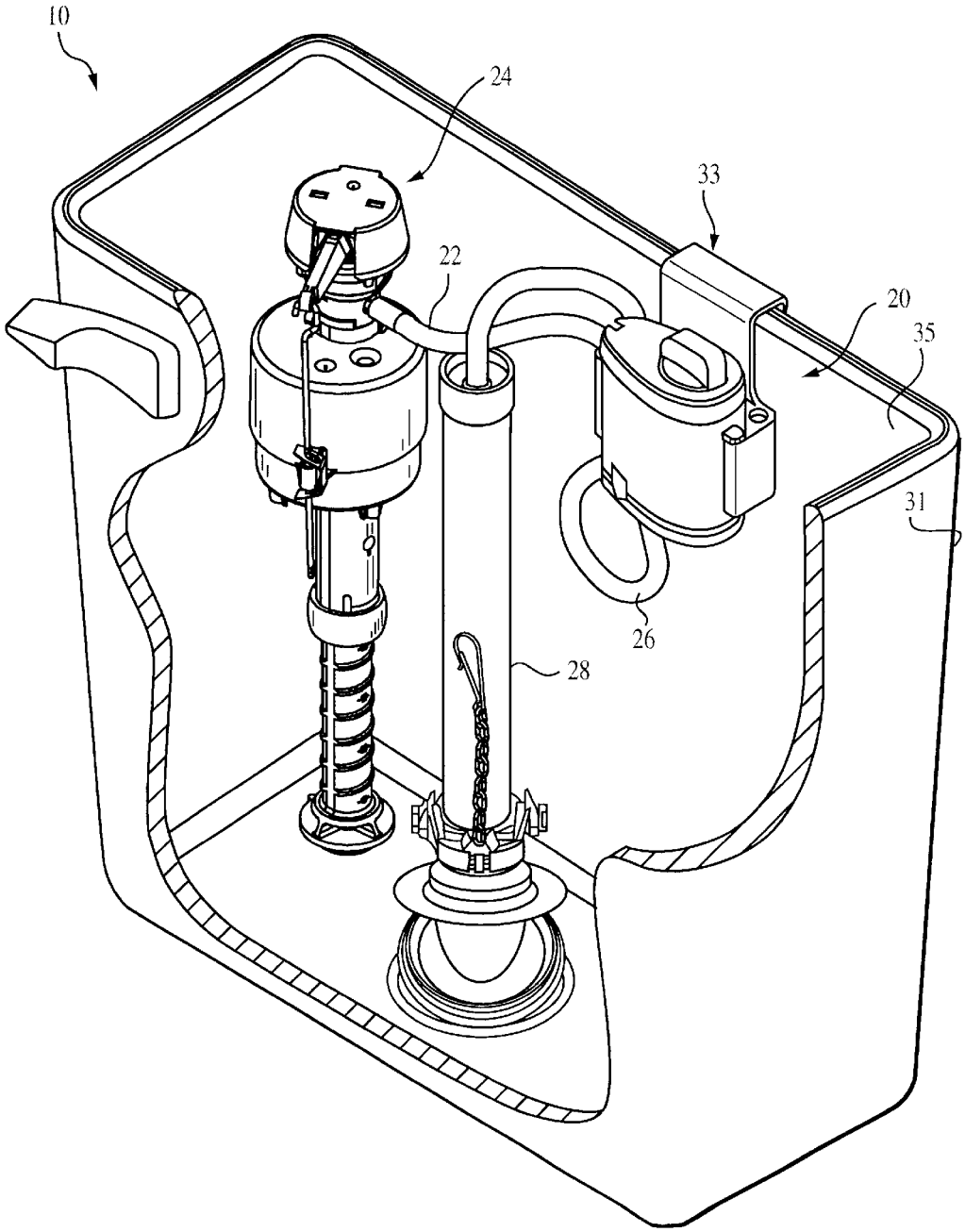
FIG. 1 is a cutaway perspective view of a toilet tank employing a first preferred embodiment of a cleaner dispenser system.

FIG. 1 is a perspective view of a toilet tank assembly 10 employing a preferred dispenser system 20 according to the invention. The dispenser assembly 20 is coupled to a fill valve 24 and an overflow tube 28. In particular, a fill tube 22 extends from the fill valve 24 to the dispenser system 20. An outflow tube 26 is coupled to the dispenser system 20 and the overflow tube 28.

The dispenser system 20 is adapted for placement within a toilet tank 31. In particular, the system 20 includes a hanger 33 configured to hang from a rear sidewall 35 of the tank 31. The system 20 is thus sufficiently compact to fit conveniently within the tank 31 while enabling easy access for maintenance.

Figure 2A:
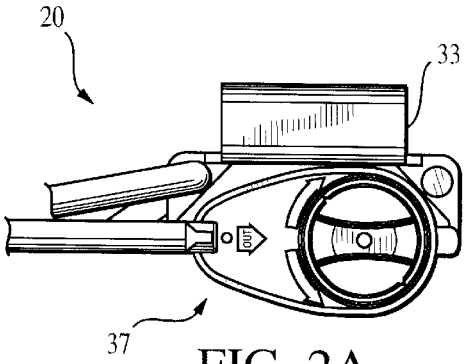
FIG. 2A is a top plan view of the toilet cleaner dispenser system.
Figure 2B:
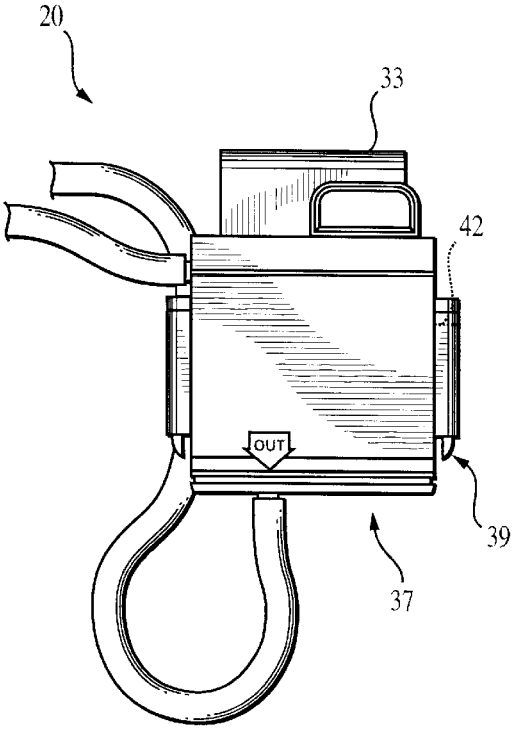
FIG. 2B is a front elevation view of the dispenser system.
Figure 2C:
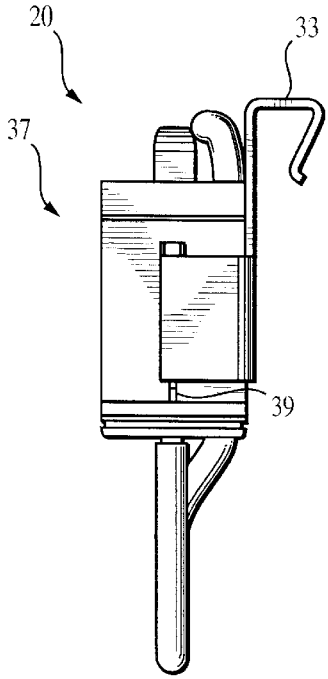
FIG. 2C is a side elevation view of the dispenser system.

In FIGS. 2A–2C, the dispenser system 20 includes a dispenser housing 37 preferably configured to be removably coupled to the hanger 33. In a preferred embodiment, the dispenser housing 37 comprises ratcheted tabs, or detents, 39, shown also in FIG. 3, that slide into slots 42 defined in the hanger 33. It is to be expressly understood that a variety of mechanisms may be employed to removably couple the dispenser housing 37 to the hanger 33.

Figure 3:
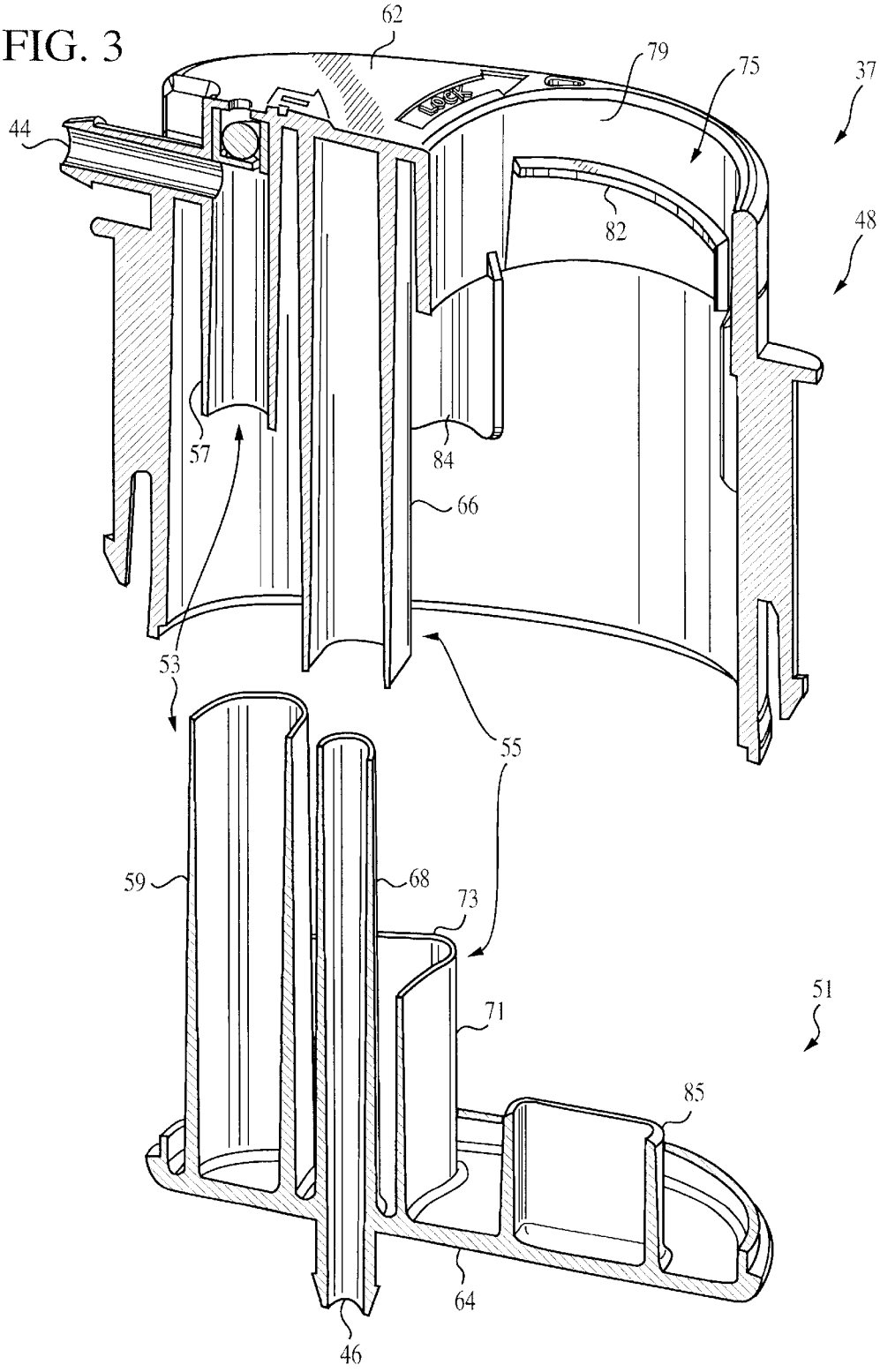
FIG. 3 is a cutaway, exploded view of a first preferred dispenser housing.

FIG. 3 is a cutaway, exploded view of a first preferred dispenser housing 37. The dispenser housing 37 includes an inlet port 44 for receiving incoming liquid from the fill tube 22 and an outlet port 46 for directing fluid out through the outflow tube 26. The inlet port 44 is preferably disposed above the outlet port 46. In a preferred embodiment, the dispenser housing 37 comprises a first portion 48 and a second portion 51 which may be formed integrally with or separately from the first portion 48. The housing 37 includes a first, or inlet, water trap 53 and a second, or outlet, water trap 55, both of which are configured to trap water so as to prevent fumes within the dispenser housing 37 from escaping into the tank 31 where they might cause damage. As described in further detail below, the water traps 53, 55 are configured to prevent fumes from entering the fill tube 22 and outflow tube 26, respectively.

The first water trap 53 comprises a first pair of aligned tubes 57, 59. The tubes 57, 59 have a nesting relationship wherein a first small tube 57 extending downwardly from a ceiling 62 of the first dispenser portion 48 is nested within a first large tube 59 extending upwardly from a floor 64 of the second dispenser portion 51.

Figure 6:
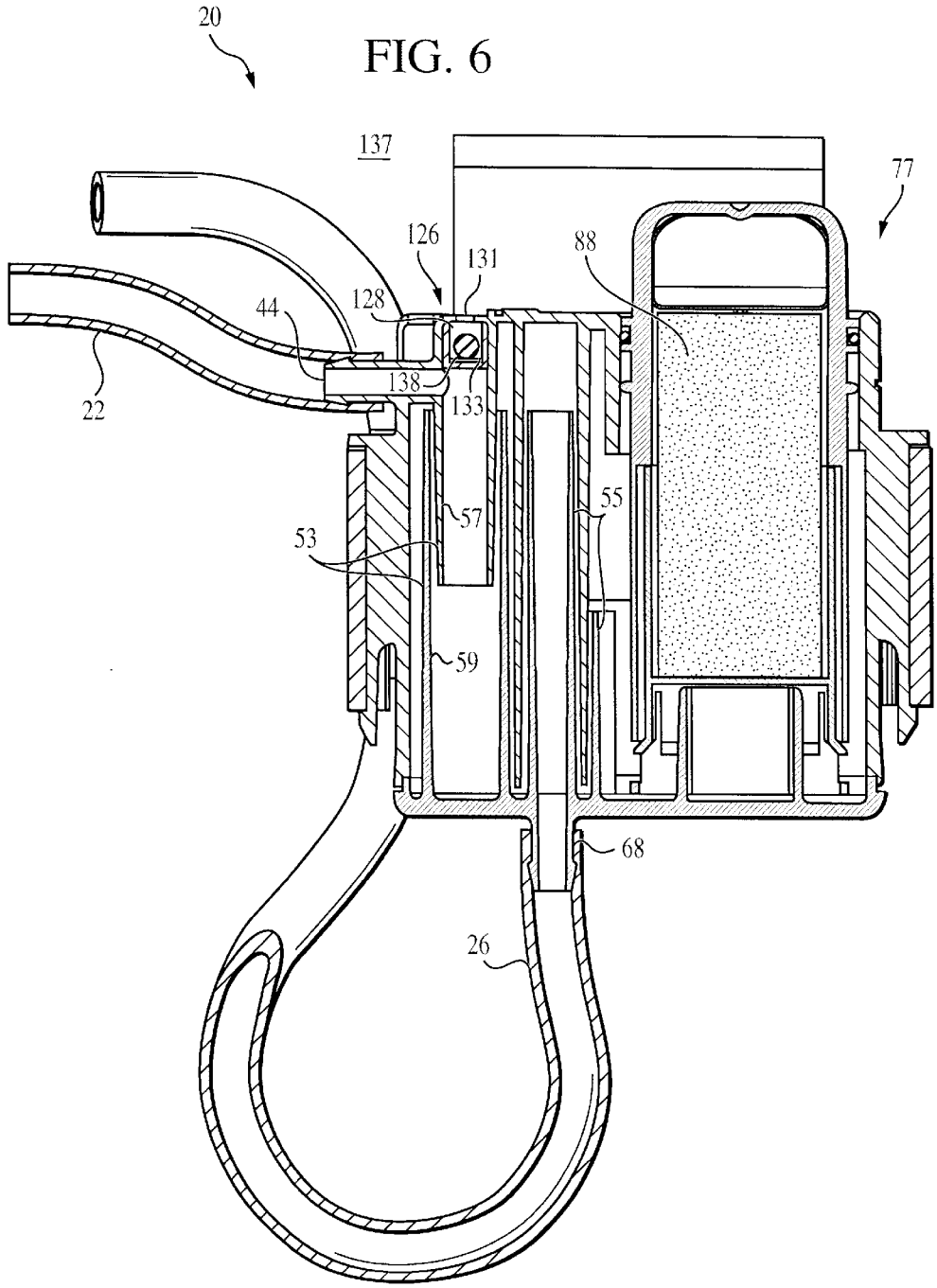
FIG. 6 is cross-sectional of view of the dispenser system prior to operation.

Accordingly, the second water trap 55 comprises a second pair of aligned tubes 66, 71 that also have a nesting relationship. In particular, a second large tube 66 extending downwardly from the ceiling 62 is nested within a water trap wall 71 extending upwardly from the floor 64. The water trap wall 71 is formed around an outlet tube 68 that is open at both ends to direct liquid out of the dispenser system 20 through the outlet port 46. The outlet tube 68 protrudes downwardly from the floor 64 so as to provide portion to be coupled to the outflow tube 26, as shown in FIG. 6. The water trap wall 71 has a top edge 73 that defines a equilibrium point, or threshold, as operatively described further below. Thus, each water trap 53, 55 comprises a downwardly extending tube 57, 66 aligned with and nested within a wider, upwardly extending tube 59, 71.

Figure 4A:
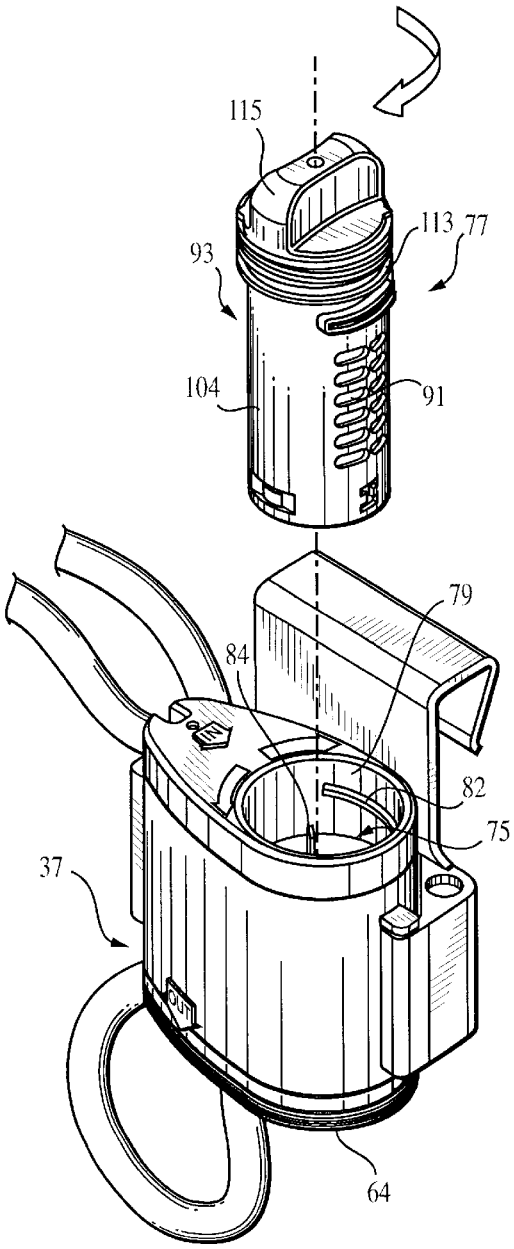
FIG. 4A is an exploded, perspective view of the dispenser system.
Figure 4B:
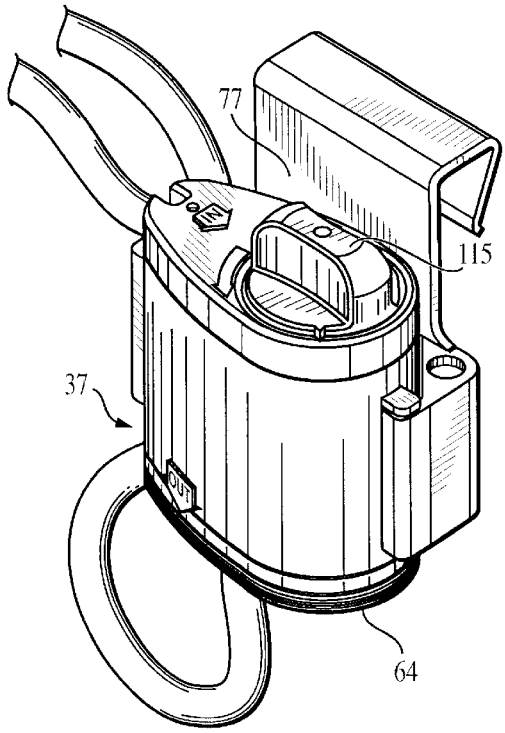
FIG. 4B is a perspective view of the dispenser system.

In FIGS. 3, 4A and 4B, the dispenser housing 37 comprises a cavity 75 configured to receive a cartridge device 77. The cavity 75 is defined by a cylinder 79 that preferably includes threads 82. A vertical guide 84 extending from the cylinder 79 serves to position and help secure the cartridge device 77 disposed in the cavity 75. A projection 85 extends upwardly from the floor 64 to secure a basket 91 of the cartridge device 77 as described further below.

In FIGS. 5A–5D, the cartridge device 77 comprises a cartridge housing 86 and a cleanser tablet 88 enclosed within. The cleanser tablet 88 is composed of a cleaning agent and is dissolvable upon contact with water. In a preferred embodiment, the cartridge housing 86 comprises a cup, or basket 91, and a cap 93 that is movable with respect to the basket 91. The basket 91 includes a cylindrical sidewall 95 with opposing portions that define a first plurality of apertures 97. In FIG. 5D, the basket 91 further comprises a base 99 that defines a slot, or groove 102 for receiving the projection 85 shown in FIG. 3.

The cap 93 also comprises a cylindrical sidewall 104 with portions that define a second plurality of apertures 106. The second plurality of apertures 106 are configured in accordance with the first plurality of apertures 97 and are thus provided in opposite groupings. A sealing gasket 108 is disposed in an annular groove 111 defined above an external threads 113. The cap 93 also comprises a top knob 115.

In a preferred method of assembly, the basket 91 and the cap 93 are brought together axially with the cleanser tablet 88 enclosed. In particular, the basket 91 and cap 93 are assembled in a closed position wherein the first plurality of basket apertures 97 are not aligned with the second plurality of cap apertures 106. In this closed position in which the cartridge device 77 would be shipped and sold, it will be appreciated that the enclosed cleanser tablet 88 is sealed from external fluid communication. The cleanser tablet 88 is further blocked from any direct human contact. Users handling the cartridge device 77 will appreciate not having to make any direct skin contact with the cleanser tablet 88. This unique safety feature also prevents children who may grab hold of the cartridge device 77 from licking, touching, or making any type of direct contact with the cleanser tablet 88.

In this closed position, the cartridge device 77 is inserted into the cavity 75 of the dispenser housing 37 as shown in FIGS. 4A and 4B. The cartridge device 77 is configured such that the cap 93 is movable with respect to the basket 91 to facilitate alternatively an open position providing fluid access to the cleanser tablet 88 and the closed position blocking fluid access to the cleanser tablet 88. In particular, the cap 93 is rotatable with respect to the basket 91 between the closed position shown in FIG. 5B, wherein the first plurality of basket apertures 97 do not have a communicating relationship with the second plurality of cap apertures (not shown), and the open position shown in FIG. 5C wherein the first plurality of basket apertures 97 have a communicating relationship with the second plurality of cap apertures 106.

A releasable locking mechanism 117 for the basket 91 and cap 93 is provided in the form of detents 119 formed at a bottom of the basket cylindrical sidewall 95 and corresponding holes 122 formed at a bottom of the cap cylindrical sidewall 104. Rotation of the knob 115, and thus rotation of the cap 93, is interrupted at precise locking positions wherein the detents 119 protrude through the holes 122, thereby releasably locking the cap to the basket 91 in a closed or open position. The detents 119 and holes 122 are configured in accordance with the configuration of the basket apertures 97 and the cap apertures 106 such that the locking positions comprise the open or closed position as discussed above.

In a preferred method of installation as shown in FIGS. 4A and 4B, the cartridge device 77 is removably coupled to the dispenser housing 37. In particular, the cartridge device 77 in the as-sold closed position is inserted into the cavity 75 of the dispenser housing 73, with the groove 102 of the basket 91 aligned with the projection 85 of the dispenser housing 37. Substantially the full length of the cap cylindrical sidewall 104 is inserted into the cavity 75. The vertical guides 84 help position the cartridge housing 86.

By turning the knob 115 in a first direction (shown clockwise in FIGS. 4A and 4B), the following occur:

1) the basket 91 is rotated with respect to the cap 93 to facilitate an open position which provides fluid access to the enclosed cleanser tablet (not shown), thereby activating the cartridge device 77;

2) the cartridge device 77 is releasably locked to the dispenser housing 37 as the external threads 113 of the cap 93 mates with the internal threads 82 of the dispenser cylinder 79.

To facilitate rotation of the cap 93 with respect to the basket 91, the basket 91 is secured to the dispenser housing 37 and kept stationary by virtue of the groove 102 of the basket 91 receiving the projection 85 of the dispenser housing as shown in FIG. 6. It will be appreciated that with a single rotating motion in the first direction, the cartridge device 77 is concurrently activated and secured to the dispenser housing 37. Accordingly, with a single rotating motion in a second direction (i.e., counter-clockwise in the illustrated embodiment) opposite to the first direction, the cartridge device 77 is deactivated as it is brought to the closed position. Concurrently, the cartridge device 77 is unlocked from the dispenser housing 37, enabling the device 77 to be removed and replaced.

FIG. 6 illustrates an installed dispenser system 20 prior to usage. The fill tube 22 extending from the fill valve (not shown) is coupled to the inlet tube 44 while the outflow tube 26 is coupled to the outlet tube 68. An anti-siphon check valve 126 included in the dispenser housing 37 comprises a valve chamber 128 with an upper valve orifice 131 and a lower aperture 133 such that the chamber 128 is in fluid communication with both the first downwardly extending tube 57 and an exterior 137 of the system 20. The valve 126 includes a ball 138 disposed within the chamber 128 and configured to block the valve orifice 131 when liquid enters the chamber 128.

Figure 7:
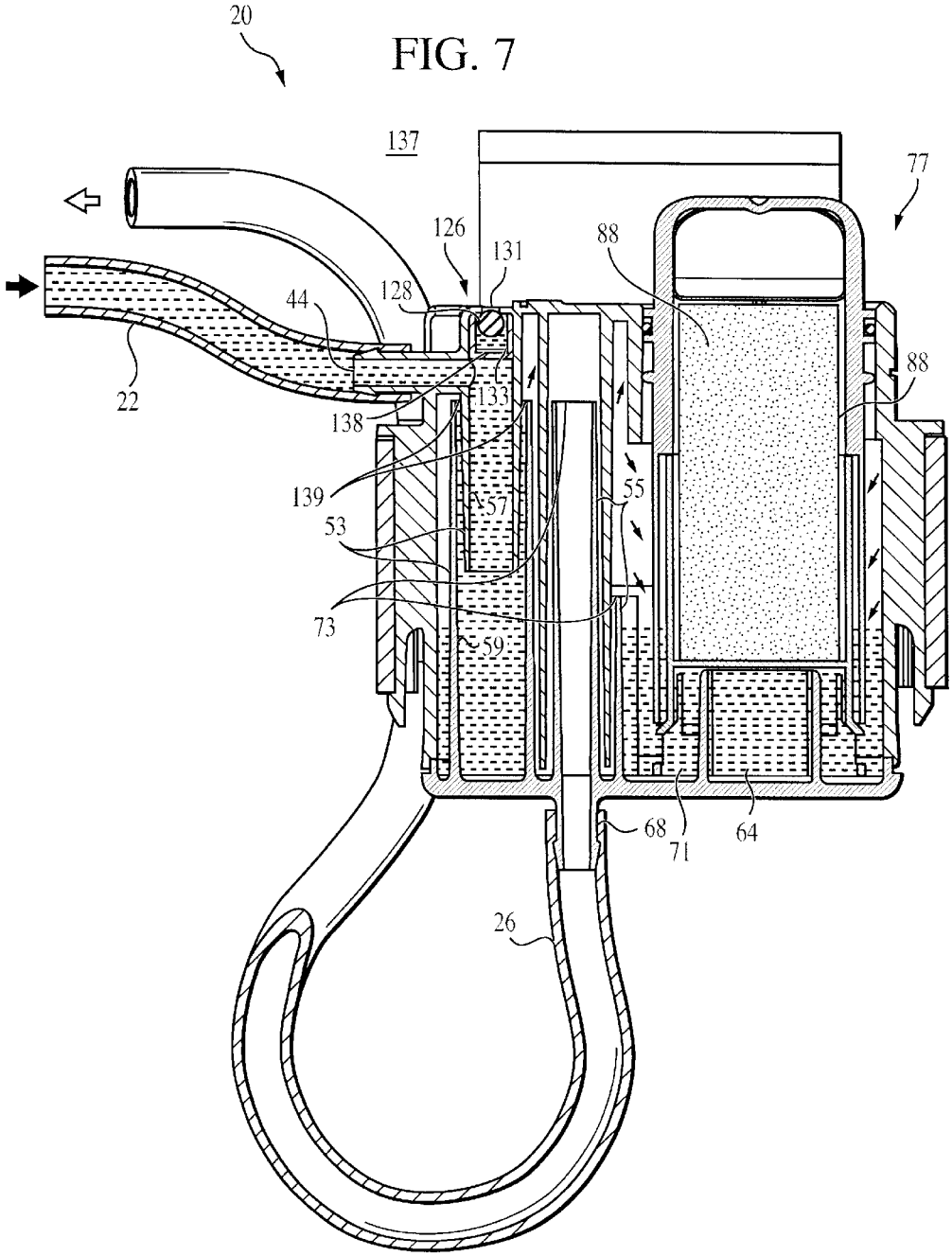
FIG. 7 is a schematic, cross-sectional front view of the dispenser system in operation as a toilet is initially flushed.

FIG. 7 illustrates the dispenser system 20 in operation as a toilet is initially flushed. Liquid enters the system 20 from the fill tube 22 through the inlet port 44. The valve chamber 128 is flooded, causing the ball 138 to seal the valve orifice 131. Liquid is directed by the first downwardly extending tube 57 into the first upwardly extending tube 59 until it rises above an inlet water trap level 139 defined by the top of the first upwardly extending tube 59. As this inlet water trap 53 is flooded, liquid overflows onto the floor 64 and begins to fill the system 20. The liquid fills the space within the system 20, including the cartridge device 77, thereby making contact with the cleanser tablet 88 and absorbing the cleaning agent. Displaced air within the system 20 is vented out through the outlet water trap 55.

Figure 8:
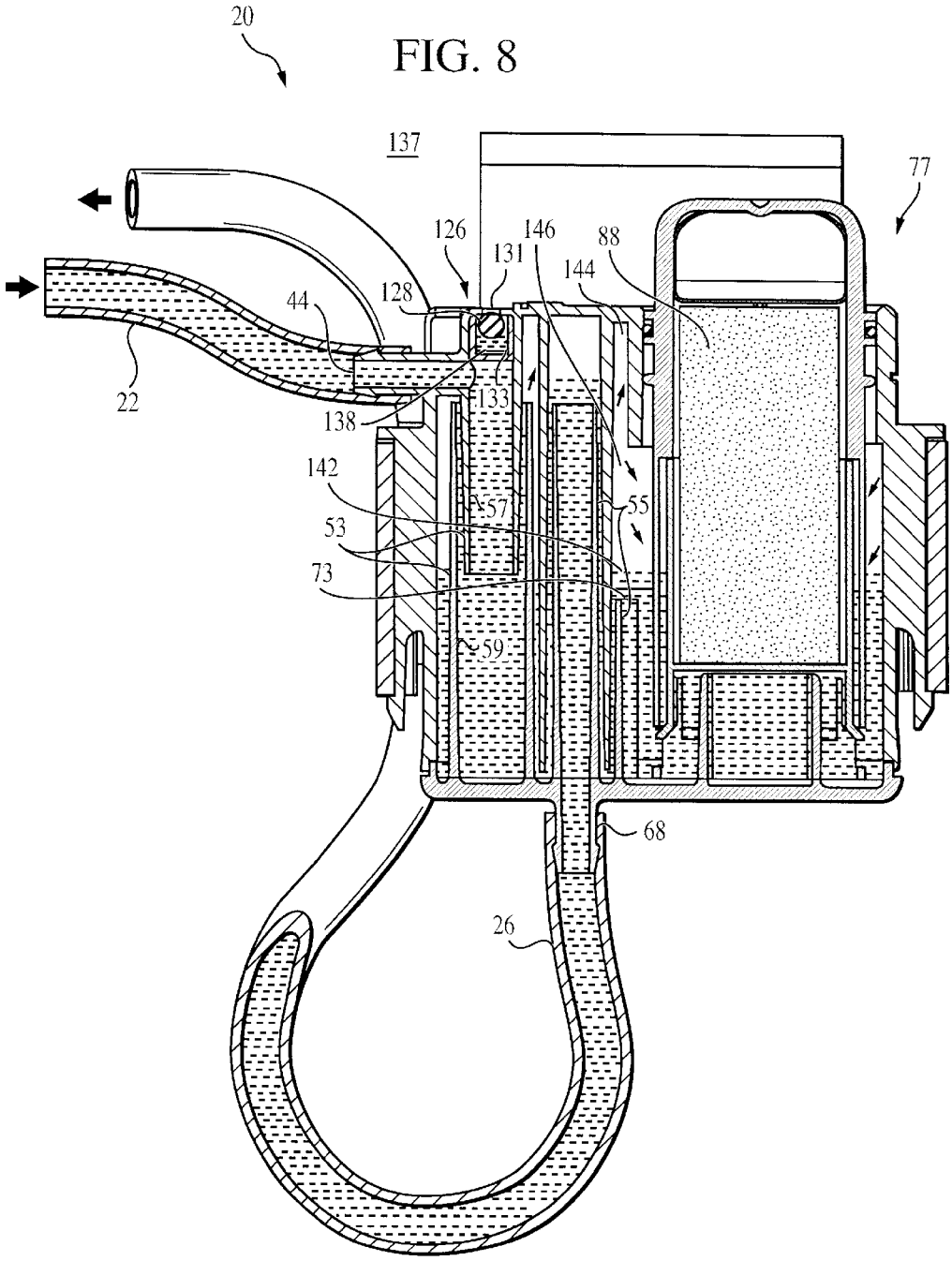
FIG. 8 is a schematic, cross-sectional front view of the dispenser system in operation as the flushing is almost complete.

As liquid continues to fill the system 20 as shown in FIG. 8, the water level 142 will rise above the top edge 73 of the water trap wall 71. At this point, liquid which has been exposed to the cleanser tablet 88 fills the outlet water trap 55 and exits the system 20 through the outlet tube 68 and the outflow tube 26. Air 144 remaining in the system 20 is trapped as pressure builds to a system equilibrium. It will be appreciated that the airspace 146 in the system 20 is minimized so as to provide optimum reaction time before liquid begins exiting the system 20. This maximizes the capacity of the liquid to absorb the cleaning agent during an initial tank flush before the toilet flush valve (not shown) closes.

Figure 9:
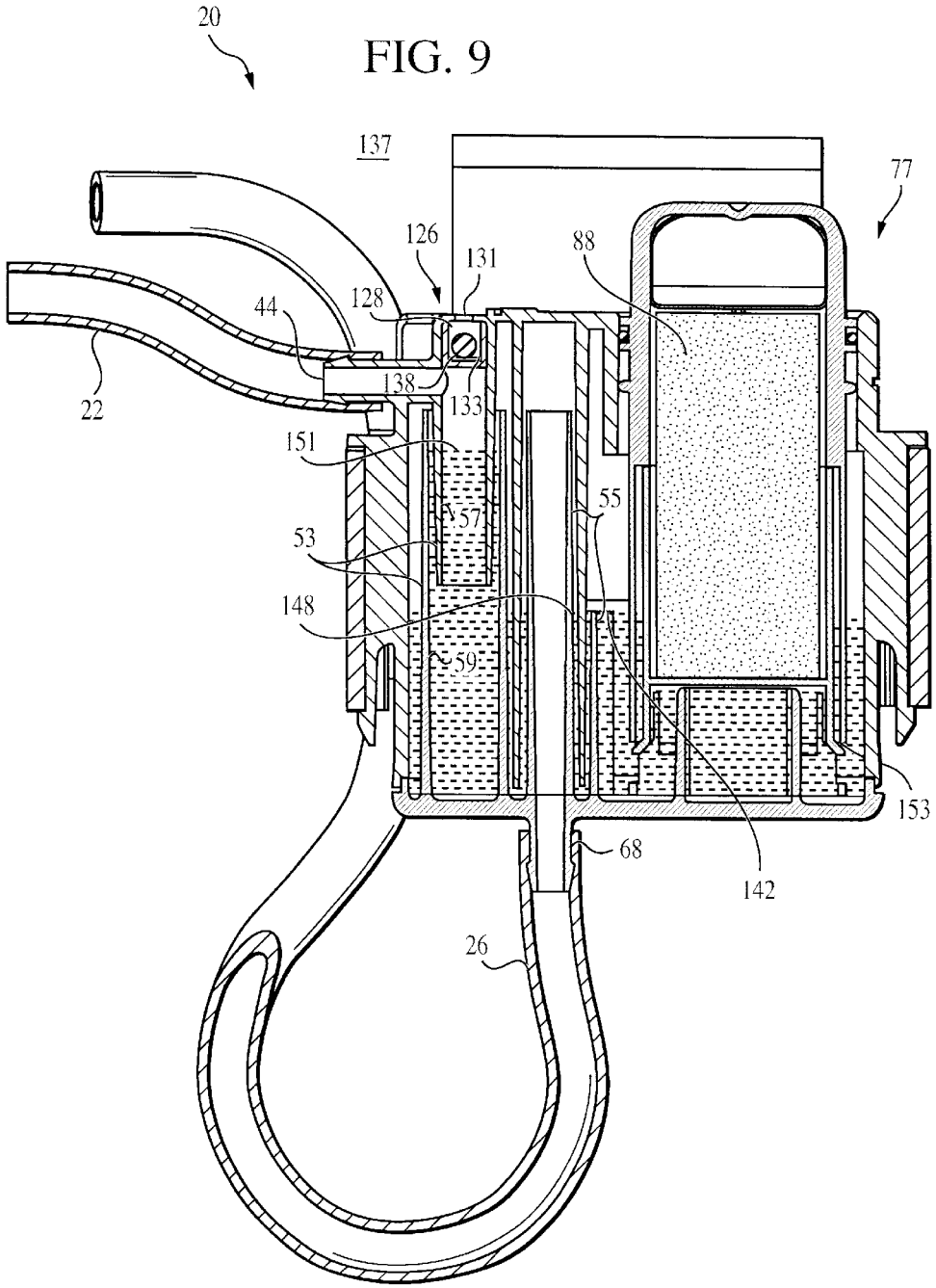
FIG. 9 is a schematic, cross-sectional front view of the dispenser system in a steady state subsequent to flushing.

Once the fill valve (not shown) has shut off, liquid continues to exit the system 20 via siphoning until the water level 142 descends to the top edge 73 of the water trap wall 71 as shown in FIG. 9. Drainage by siphoning may be accomplished by positioning a distal end (not shown) of the flexible outflow tube 26 at a level below the dispensing system 20. While the outlet tube 68 is emptied of liquid, the outlet water trap 55 retains liquid disposed between an outer surface of the outlet tube 68 and an inner surface of the second downwardly extending tube 66. Similar to the water level 142 outside the outlet water trap 55, the water level 148 within the outer water trap 55 also descends to the height of the top edge 73 of the water trap wall 71. The inlet water trap 53 also retains liquid with a water level 151. Air enters the check valve 126 as the ball 138 drops.

Therefore, once siphoning ceases, liquid is retained in both the inlet water trap 53 and the outlet water trap 55, thereby sealing the airspace 146 defined therebetween. Air 144 in this airspace 146 which may include fumes released as a result of the dissolution of the cleanser tablet 88 is trapped. Thus, the trapped air 144 is prevented from escaping the system 20 through the inlet tube 44 or the outlet tube 68. The cleanser tablet 88 is partially submerged in the residual water 153 outside the water traps 53, 55. It will be appreciated that the top edge 73 of the water trap wall 71 may be adjusted to alter the height of the residual water 153 at a higher or lower level relative to the cleanser tablet 88.

Figure 10:
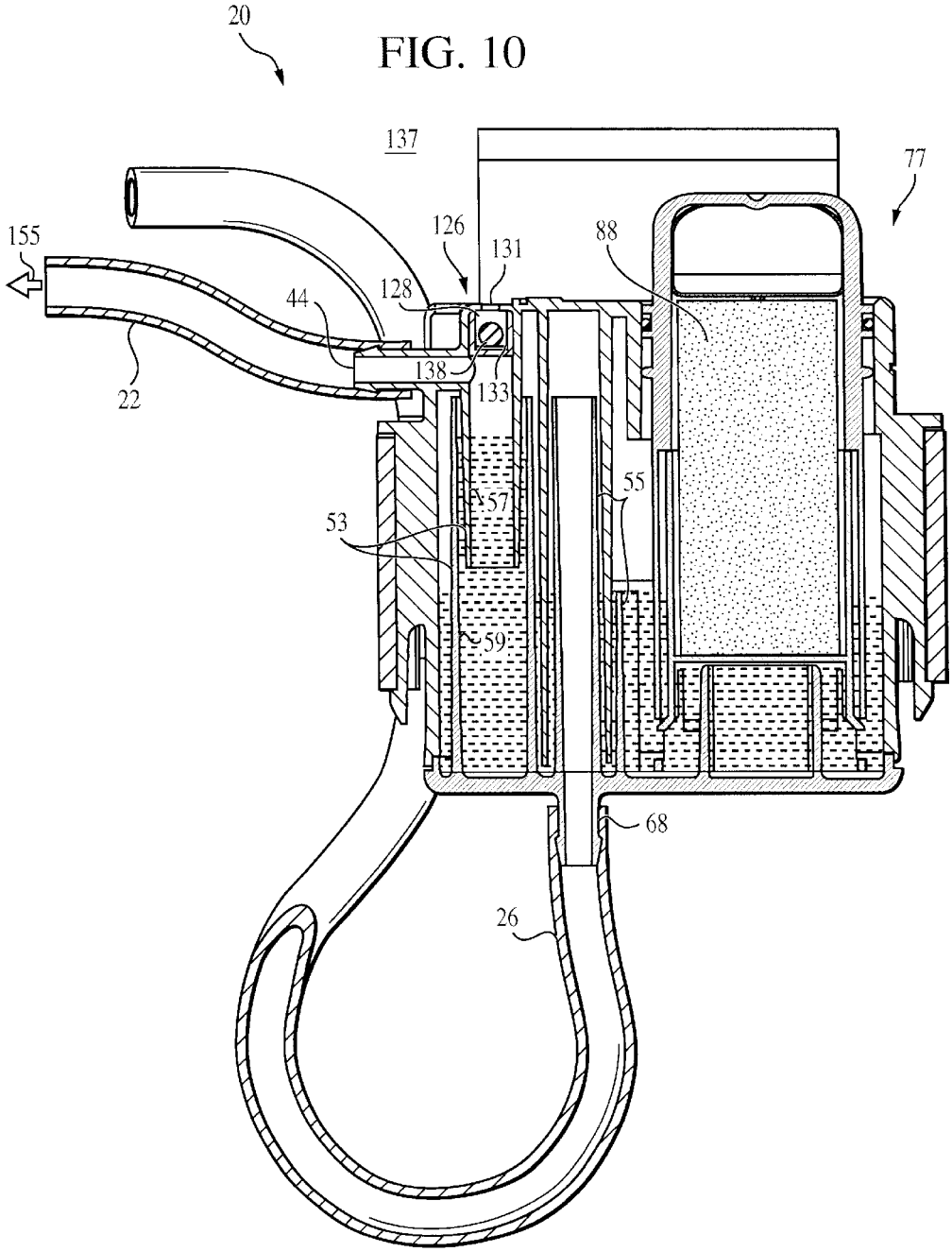
FIG. 10 is a schematic front view of the dispenser system illustrating a vacuum breaking, or anti-siphoning, feature in effect during the steady state.

In FIG. 10, it will be appreciated that an anti-vacuum, or vacuum breaking, feature is facilitated by the check valve 126. In particular, should air be drawn out of the inlet tube 44 through the fill tube 22, as indicated by arrow 155, air outside the system 20 is drawn in through the check valve 126, thereby breaking any potential vacuum. Air entering the check valve 126 percolates above the water level 151 in the inlet water trap 53 and travels out the fill tube 22, but does not enter the sealed off airspace 146.

FIGS. 11A–11C illustrate a second preferred embodiment of a removable cartridge device 157. The cartridge device 157 comprises a cleanser tablet 159 enclosed within a cartridge housing 162. The cartridge housing 162 comprises a main cylindrical sidewall 164 with portions defining a plurality of apertures 166. A top portion 168 of the housing 162 includes a turning knob 171, a groove 173 that receives a gasket 175, and external threads 177. The cartridge housing 162 also comprises a base 178. The base 178 includes a bottom floor 179 with a plurality of apertures 182. An upwardly extending cylindrical rim 184 is configured to fit within and abut the main cylindrical sidewall 164. Therefore, unlike the first preferred cartridge 77 which includes a pair of concentric sidewalls 95, 104 movable with respect to each other to facilitate open and closed positions as shown in FIGS. 5A–5D, the second preferred cartridge housing 162 comprises a single sidewall 164. The bottom groove 102 of the first preferred cartridge device 77 is preferably omitted in the second preferred cartridge housing 162 since the cartridge housing 162 does not comprise parts that are movable with respect to each other. The cartridge housing 162 may be provided as one integral housing, or as a plurality of separate parts.

The second preferred cartridge device 157 thus remains in a constant open position. It will be appreciated that the encapsulated cleanser tablet 159 is nonetheless shielded from direct contact with a user. Installation and removal of the cartridge device 157 follows substantially the same procedure as described above in connection with the first preferred cartridge device 77. Unlike the first preferred cartridge device 77, however, rotating the second preferred cartridge device 157 to lock or unlock comprises rotating the entire cartridge housing 162 as one unit since the housing 162 omits parts that are movable with respect to each other.

Figure 12:
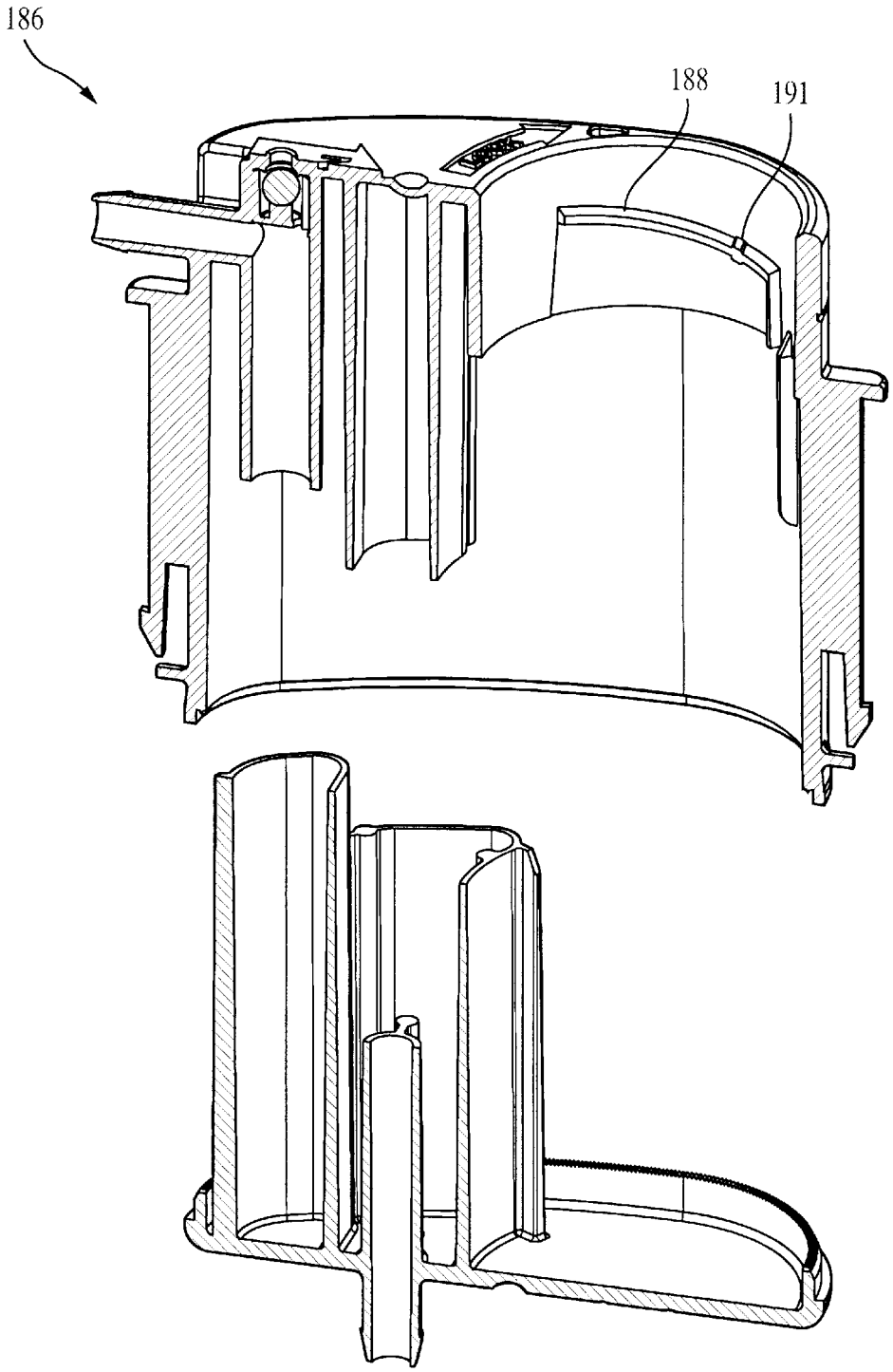
FIG. 12 is a cutaway, exploded view of a second preferred dispenser housing.

With reference to FIGS. 11A–11C and FIG. 12, a detent locking mechanism is provided. In FIG. 12, a second preferred dispenser housing 186 has a substantially similar structure as the first preferred dispenser housing 37 shown in FIG. 3, except that the second preferred dispenser housing 186 includes internal threads 188 with at least one projection, or bump, 191. In FIGS. 11A–11C, gaps, or breaks, 193 are formed in the external threads 177 so as form a space, or void, for releasably receiving the projection 191. Thus, the projection 191 and the gaps 193 collectively form the detent locking mechanism which enables the cartridge device 157 to be releasably locked in a fixed position with respect to the dispenser housing 186. Though releasable by manual operation, the detent locking mechanism prevents the cartridge device 157 from self disengagement under cycling pressure with normal usage.

With all the preferred embodiments of the cartridge devices, a disposable toilet cleaner system, or replacement system, is provided wherein a plurality of disposable, replacement cartridge devices may be provided for a single dispenser housing. Unlike conventional approaches in which separately sold cleanser tablets must be handled by the user, the disposable system according to the invention prevents any direct human contact with the enclosed cleanser tablet. Replacement cartridge devices, each with its own enclosed cleanser tablet, may be sold separately from the dispenser housing.

It will further be appreciated that an associated method for replacing toilet cleaner tablets is provided that prevents the user from directly contacting any cleanser tablet. To replenish the dispensing system, a user may simply remove and discard an existing, depleted cartridge device. A new cartridge device may then be installed by inserting the device into the cavity of the dispenser housing and twisting the knob in a first direction to releasably lock the cartridge device to the dispenser housing. Accordingly, twisting the knob in a second opposite direction will unlock the cartridge device from the dispenser housing, enabling the device to be retracted and thereafter discarded. Thus, in each embodiment, a bayonet coupling is provided between the dispenser housing and the cartridge housing. In particular, the cartridge housing is twisted with respect to the dispenser housing so as to form a releasable lock that prevents axial retraction of the cartridge housing.

Many alterations and modifications may be made by those having ordinary skill in the art without departing from the spirit and scope of the invention. Therefore, it must be understood that the illustrated embodiments have been set forth only for the purposes of examples and that they should not be taken as limiting the invention as defined by the following claims. For example, notwithstanding the fact that the elements of a claim are set forth below in a certain combination, it must be expressly understood that the invention includes other combinations of fewer, more or different ones of the disclosed elements.

The words used in this specification to describe the invention and its various embodiments are to be understood not only in the sense of their commonly defined meanings, but to include by special definition in this specification the generic structure, material or acts of which they represent a single species.

The definitions of the words or elements of the following claims are, therefore, defined in this specification to not only include the combination of elements which are literally set forth. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptionally equivalent, what can be obviously substituted and also what incorporates the essential idea of the invention.

What is claimed is:

1. A toilet cleaner dispensing system, comprising:

a dispenser housing having an opening;

a first downwardly extending tube and a first upwardly extending tube included in the dispenser housing, the first downwardly extending tube having a first nesting relationship with the first upwardly extending tube to form an inlet water trap;

a second downwardly extending tube and a second upwardly extending tube included in the dispenser housing, the second downwardly extending tube having a second nesting relationship with the second upwardly extending tube to form an outlet water trap; and a cartridge housing removably coupled to the dispenser housing, the cartridge housing being configured to fit in the opening.

2. The system of claim 1, further comprising a tablet composed of a toilet cleaning agent and disposed within the cartridge housing.

3. The system of claim 1, further comprising means for releasably locking the cartridge housing to the dispenser housing.

4. The system of claim 1, further comprising a detent locking mechanism.

5. A toilet cleaner dispensing system, comprising:

a dispenser housing including an inlet water trap, an outlet water trap, and an opening;

a cartridge housing removably coupled to the dispenser housing, the cartridge housing being configured to fit in the opening; and a detent locking mechanism comprising a projection included in the dispenser housing and a void included in the cartridge housing and configured to receive the projection.

6. A disposable toilet cleaning system adapted for use with a toilet including a tank, the cleaning system comprising:

a toilet cleaning dispenser adapted for disposition in the tank of the toilet, the dispenser including a dispenser housing with a cavity;

a first downwardly extending tube and a first upwardly extending tube included in the dispenser housing, the first downwardly extending tube having a first nesting relationship with the first upwardly extending tube to form an inlet water trap;

a second downwardly extending tube and a second upwardly extending tube included in the dispenser housing, the second downwardly extending tube having a second nesting relationship with the second upwardly extending tube to form an outlet water trap; and a plurality of disposable cartridge devices, each disposable cartridge device comprising a cartridge housing and a cleanser tablet disposed within the cartridge housing, each cartridge housing being configured to removably fit in the cavity.

7. The system of claim 6, wherein each cartridge housing comprises:

a cylindrical sidewall with a first plurality of apertures; and a base with a second plurality of apertures.

8. The system of claim 6, wherein the disposable cartridge housing comprises:

a cap with a first aperture; and a basket having a second aperture.

9. The system of claim 8, wherein the cap is movable with respect to the basket to facilitate an open position in which the first aperture is aligned with the second aperture and a closed position in which the first aperture is not aligned with the second aperture.

10. A toilet cleaning dispenser assembly, comprising:

a dispenser housing comprising an opening; and a cartridge device adapted to be releasably locked to the dispenser housing, the cartridge device comprising a cartridge housing configured to fit in the opening and a cleanser tablet disposed within the cartridge housing; wherein at least a portion of the cartridge housing is movable with respect to the dispenser housing to facilitate alternatively a locked relationship with the dispenser housing and an unlocked relationship with the dispenser housing.

11. The dispenser assembly of claim 10, wherein the portion of the cartridge housing that is movable with respect to the dispenser housing comprises a cap with a knob.

12. The dispenser assembly of claim 11, wherein the cartridge housing further comprises a basket coupled to the cap.

13. The dispenser assembly of claim 10, wherein:

the dispenser housing further comprises an internal thread disposed in the opening, the internal thread including a projection; and the cartridge housing comprises an external thread with a void configured to receive the projection.

14. The dispenser assembly of claim 10, wherein the cartridge housing comprises:

a cylindrical sidewall with a first plurality of apertures; and a base with a second plurality of apertures.

15. The dispenser assembly of claim 14, wherein the cylindrical sidewall is rotatable with respect to the base to facilitate alternatively an open position wherein the first plurality of apertures are aligned with the second plurality of apertures, and a closed position wherein the first plurality of apertures are not aligned with the second plurality of apertures.

16. The dispenser assembly of claim 10, wherein the cartridge housing is rotatable with respect to the dispenser housing to facilitate alternatively the locked relationship and the unlocked relationship.

17. The dispenser assembly of claim 10, wherein the cartridge housing is substantially enclosed.

18. The dispenser assembly of claim 10, wherein the dispenser housing further comprises an inlet water trap and an outlet water trap.

19. The dispenser assembly of claim 18, wherein:

the inlet water trap comprises a first pair of vertically nested tubes; and the outlet water trap comprises a second pair of vertically nested tubes.

20. A disposable toilet cleaning system adapted for use with a toilet including a tank, the cleaning system comprising:

a toilet cleaning dispenser adapted for disposition in the tank of the toilet, the dispenser including a dispenser housing comprising an inlet water trap, an outlet water trap, a cap with a first aperture, a basket with a second aperture, and a cavity; and a plurality of disposable cartridge devices, each disposable cartridge device comprising a cartridge housing and a cleanser tablet disposed within the cartridge housing, each cartridge housing being configured to removably fit in the cavity, wherein the cap is movable with respect to the basket to facilitate an open position in which the first aperture is aligned with the second aperture and a closed position in which the first aperture is not aligned with the second aperture.

21. A toilet cleaning dispenser assembly, comprising:

a dispenser housing comprising an opening and an internal thread disposed in the opening, the internal thread including a projection; and a cartridge device adapted to be releasably locked to the dispenser housing, the cartridge device comprising a cartridge housing configured to fit in the opening and a cleanser tablet disposed within the cartridge housing, the cartridge housing comprising an external thread with a void configured to receive the projection; wherein at least a portion of the cartridge housing is movable with respect to the dispenser housing to facilitate alternatively a locked relationship with the dispenser housing and an unlocked relationship with the dispenser housing.

* * * * *